United States Patent [19]

Hammon et al.

[11] Patent Number: 4,844,470

[45] Date of Patent: Jul. 4, 1989

[54] GOLF MAT

[75] Inventors: Mark A. Hammon; Steven J. Ackerman, both of Des Moines, Iowa

[73] Assignee: Ste-Mak, Inc., Ankeny, Iowa

[21] Appl. No.: 202,398

[22] Filed: Jun. 6, 1988

[51] Int. Cl.[4] ..... A63B 69/36

[52] U.S. Cl. ..... 273/195 R

[58] Field of Search ..... 273/195 R, 195 A, 195 B, 273/176 R, 176 AA, 176 AB, 176 E, 176 F, 176 FA, 176 FB, 176 G–176 J, 177 R, 178 B, 183 A, 33, 35 R, 202, DIG. 12, DIG. 13, 186 R, 196 R–199 R; 15/217, 238, 239

[56] References Cited

U.S. PATENT DOCUMENTS

| | | | |
|---|---|---|---|
| 3,599,982 | 8/1971 | Elesh | 273/195 A |
| 3,661,687 | 5/1972 | Spinney, Jr. et al. | 273/176 J |
| 3,870,314 | 3/1975 | Bertucci | 273/195 R |
| 4,387,896 | 6/1983 | O'Brien | 273/195 A |

FOREIGN PATENT DOCUMENTS

| | | | |
|---|---|---|---|
| 2107593 | 5/1983 | United Kingdom | 273/195 B |

*Primary Examiner*—Edward M. Coven
*Assistant Examiner*—S. Passaniti
*Attorney, Agent, or Firm*—Zarley, McKee, Thomte, Voorhees & Sease

[57] ABSTRACT

A golf mat of grass-like material includes top and bottom pads, each of which includes belting material which substantially strengthens them and protects the mat from damage from golf clubs striking it. The golf tee extends only through the top pad and not through the mat and the belting material of the top pad prevents any enlargement of the hole through the top pad which includes felt carpet which also gives a grass-like appearance. The top pad is loosely secured to the mat and may be raised at its center for replacement of the tee, and the top pad absorbs energy from the golf club due to its ability to move relative to the mat when it is struck. The pad may be replaced through operation of the bolts at its opposite ends.

9 Claims, 2 Drawing Sheets

GOLF MAT

BACKGROUND OF THE INVENTION

Golf mats used at driving ranges suffer considerable damage through ordinary, unintentional but abusive use. The golfer practicing his shots from the tee will often hit the mat with his club rather than cleanly hitting the ball off of the tee. The substantial usage the golf mat receives gives the mat a very short lifetime because of the damage done to the mat in the area of the tee.

Another problem with conventional golf mats is that they will delaminate along the peripheral edges. Accordingly, what is needed is a golf mat which has been substantially strengthened and is resistant to unintentional, abusive wear and tear. The mat should include parts which may be readily replaced as they wear out, saving replacing the entire mat. Protection should be provided to the edges of the mat to prevent separation of the laminations.

SUMMARY OF THE INVENTION

The golf mat of this invention is comprised of three components which are bolted together. A mat is sandwiched between two elongated pads made of belting material. The opposite ends of the pads are bolted together through the mat. Needle punch felt having a grass-like appearance is sewn to the top of the top pad, and the top pad is recessed into the top face of the mat. A replaceable tee has a base positioned between the mat and the top pad, and a stem which extends through the top pad. The tee may be easily replaced as required, and the top pad is of sufficient size that it protects the mat against wear from hits from golf clubs, and if necessary, the top pad may be replaced, as required.

The top and bottom pads are loosely secured to the mat through their midsections, thereby allowing give when struck by a golf club which absorbs energy which might otherwise damage the pad or the mat.

The mat includes laminations of tufted cut pile spiked turf and sponge rubber having polyethylene backing on its top side and nylon fiber on the bottom side, thereby giving the mat substantial cushioning and strength. The edging of the mat is sealed by being serged, whereby the edge has a knitted or crocheted appearance which prevents any delamination from occurring and gives it a distinctive appearance.

DESCRIPTION OF THE PREFERRED EMBODIMENT

Figure 1:
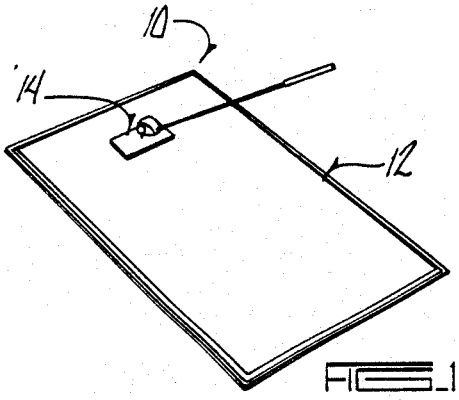
FIG. 1 is a top perspective view of the golf mat of this invention.

The golf mat of this invention is referred to generally in FIG. 1 by the reference numeral 10 and includes a base mat 12 to which top and bottom pads 14 and 16 are secured by a pair of bolt assemblies 18 at each end which extend through the mat 12.

Figure 4:
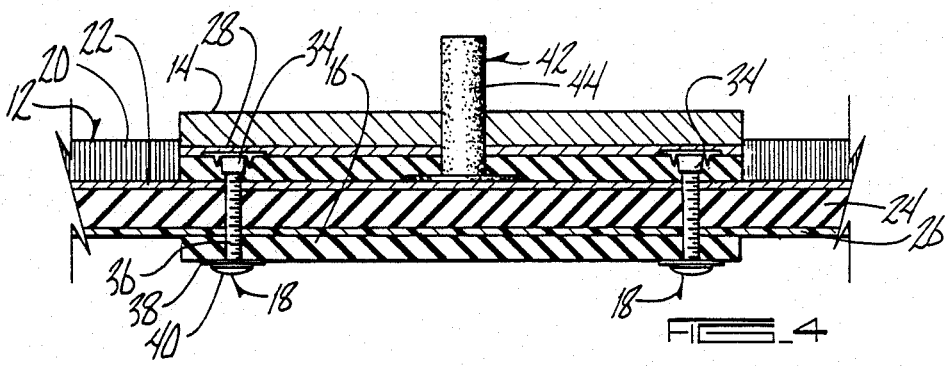
FIG. 4 is a cross-sectional view taken along line 4—4 in FIG. 2.

The mat 12, as seen in FIG. 4, includes a top layer of tufted, cut pile spike turf 20 which gives a grass-like appearance adhesively bonded to a layer of polypropylene backing 22 treated with urethane pre-coat which in turn is adhesively bonded to a layer of sponge rubber 24 which carries a skirm nylon fiber backing 26.

Figure 6:
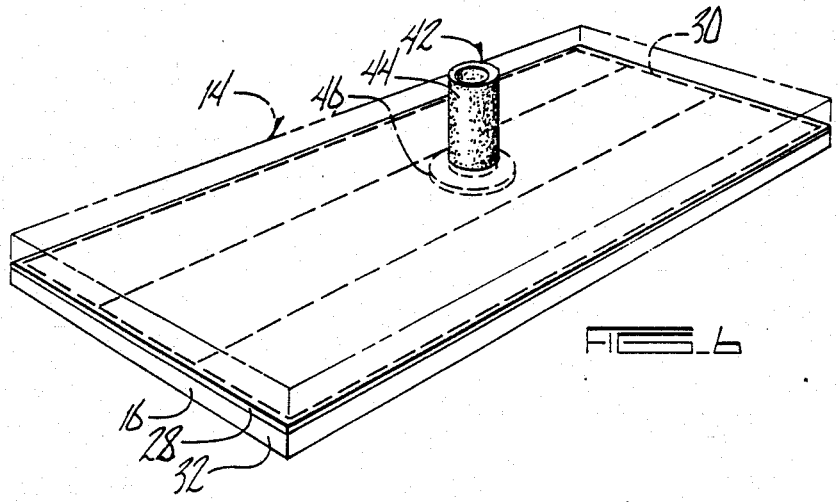
FIG. 6 is a top perspective view of the top pad.
Figure 7:
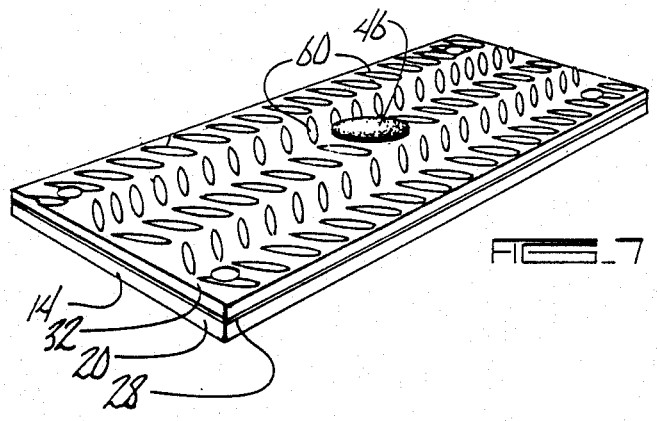
FIG. 7 is a bottom perpsective view of the top pad.
Figure 8:
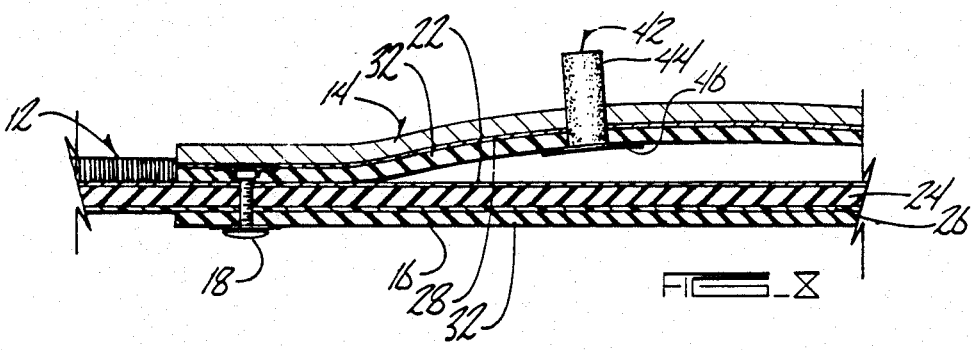
FIG. 8 is a cross-sectional view taken along line 8—8 in FIG. 2 showing the top pad being lifted above the mat for replacing the tee.

The top pad 14 has a top layer of needle punch felt which also gives a grass-like appearance and is secured by adhesive 28 and stitching 30, as seen in FIG. 6, to an elongated strip of belting material 32. A T-nut 34, as seen in FIG. 8, is positioned between the belting 32 and the backing 28 of the top pad 14, and receives the bolt 36 from the bottom of the mat. The bottom pad 16 completes the package and is held in place by the bolt assembly 18. A washer 38 is provided against the head 40 of the bolt 36 on the bottom face of the bottom pad 16.

Figure 2:
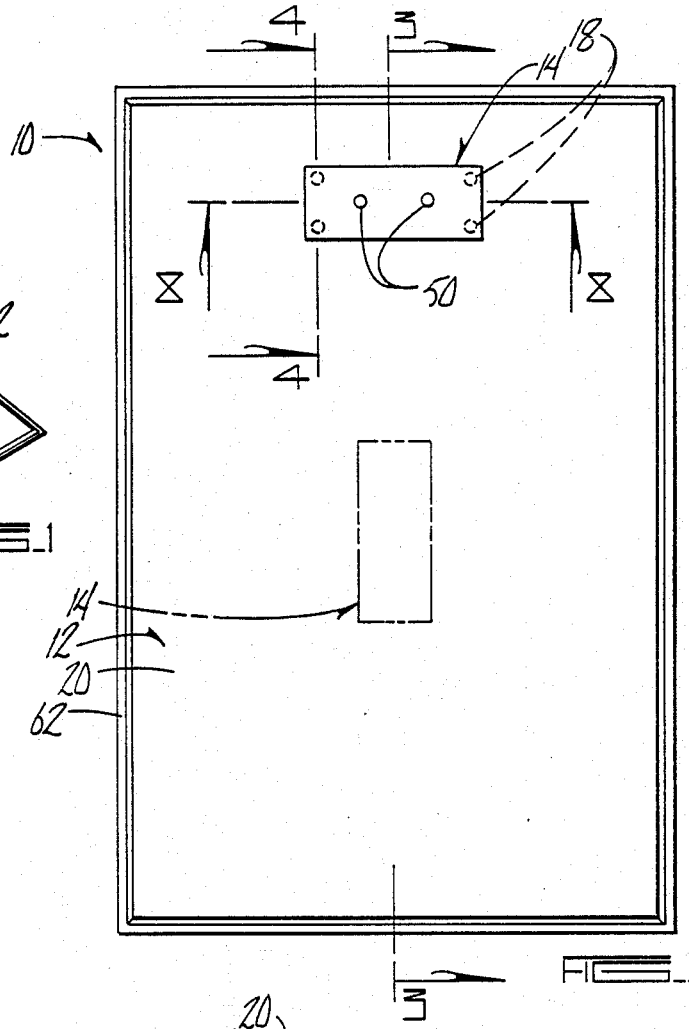
FIG. 2 is a top plan view thereof.
Figure 9:
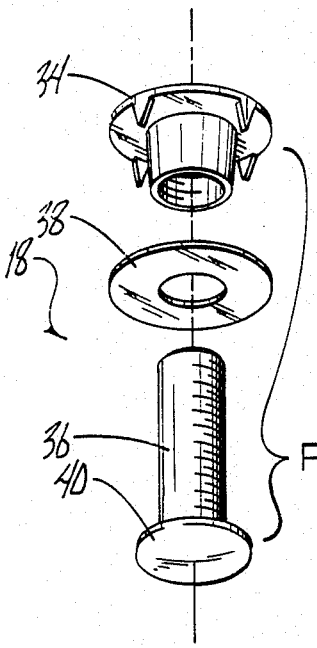
FIG. 9 is an enlarged perpsective view of the bolt assembly.

A golf tee 42, having a stem 44 and a base 46, extends through the top pad 14 with the base being positioned between the top of the mat 12 and the bottom of the top pad 14. As seen in FIG. 8, the top pad may be lifted up from the mat 12 to allow the tee 42 to be replaced as required. As seen in FIG. 2, alternate optional holes 50 are provided in the top pad 14 to help distribute the wear on the pad 14. The holes are preferably located approximately 4 inches from the ends of the pad 14.

As seen in FIG. 4, the tufted, cut pile spike turf has been shaved away to provide a recessed area having the same area dimensions as the top pad 14, such that the top surface of the top pad 14 is close to being coplanar with the top surface of the pad 12.

The top and bottom pads 14 and 16 each have on their bottom surfaces a grid of elliptical-shaped shoulders 60 which, in the case of the bottom pad 16, help to frictionally secure the mat in place on the ground.

Figure 5:
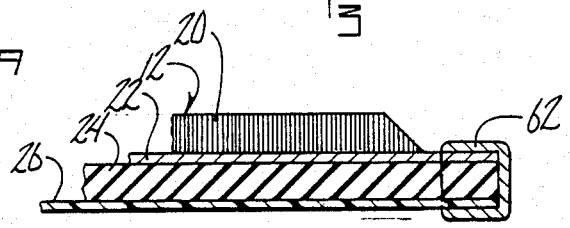
FIG. 5 is an enlarged cross-sectional view of the edge area of the mat indicated in FIG. 3 by the lines 5—5.
Figure 3:
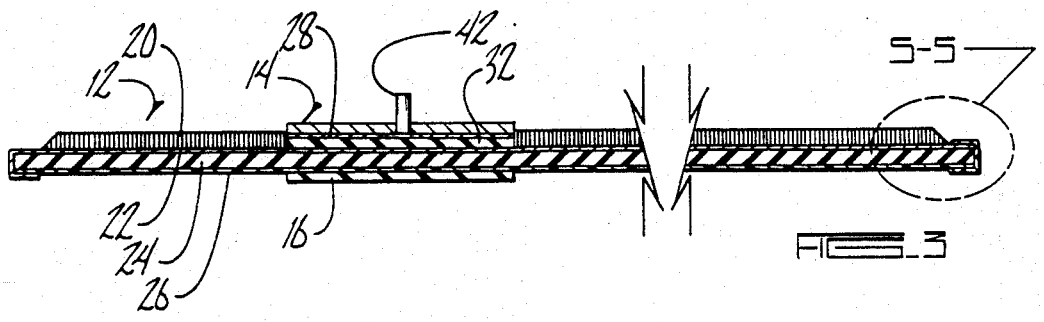
FIG. 3 is a cross-sectional view taken along line 3—3 in FIG. 2.

As seen in FIG. 5, the edge of the mat is serged with endless loops of cord material 62 giving the edge a knitted or crocheted appearance. This serging seals the mat edge and prevents any moisture from getting between the laminations of turf 20, polypropylene backing 22 and nylon fiber backing 26 and the sponge rubber sheet 24.

Thus, it is seen in use that the golfer may stand either on the mat 12 or off of it with the golf ball being placed on the tee 42. If the head of the golf club strikes the mat, the mat will be protected by the top pad 14 which is of a sufficient area to accept most hits from erratic golfers. The tee 42 would have a tendency to enlarge the hole in the mat in the normal practice golf mat, but in this invention, the tee does not extend through the mat but only through the top pad 14 which has been substantially strengthened by the use of the belting 32 which is nearly indestructible. The top surface of the top pad 14, including the felt material, will be protected and the holes 50 will not be enlarged by the tee 42, even though the tee may be destroyed from repetitive strikes from a golf club. In this case, the tee 42 is simply replaced, as shown in FIG. 8. The only thing that will eventually wear is the felt carpet of the top pad 14, and this may be replaced, if needed, by simply removing the bolts 18 and reinstalling a new top pad 14.

The sponge rubber 24 of the mat 12 is Goodyear Plioflex SBR. The needle punch felt carpet material may be obtained from General Felt, Inc., Philadelphia, Pa. The tufted cut pile spike turf is obtained from Instant Terf, Dalton, Ga.

What is claimed is:

1. A golf mat comprising, a base mat including a layer of cushion material to which a cover layer of grass-like carpet is secured by adhesive, a top pad on said base mat, said top pad including a layer of durable flexible belting type material to which a cover layer of grass-like carpet is secured by adhesive, a bottom pad of durable flexible belting type material is provided under said base mat in vertical alignment with said top pad, a golf tee on the top side of said base mat extending through only said top pad, and said top and bottom pads being elongated with midsections between opposite ends and said pads being secured by fastening means only at their opposite ends to said base mat leaving their midsections free for limited horizontal movement in response to horizontal impact from a golf club striking said tee or said top pad while said cushion tends to absorb club impact in a vertical direction.

2. The structure of claim 1 wherein said fastening means is further defined as being a plurality of bolts extending through said bottom pad, said base mat and said layer of belting type material in said top pad.

3. The structure of claim 2 wherein said bolts terminate below the layer of grass-like carpet on said belting type material in said top pad thereby avoiding damage to clubs upon hitting said top pad.

4. The structure of claim 1 wherein said top pad is substantially smaller in area than said base mat, and said grass-like carpet on said base mat under said top pad has been removed allowing said top pad to be loosely recessed into said base mat.

5. The structure of claim 4 wherein the top pad and base mat have top surfaces which are substantially coplanar.

6. The structure of claim 5 wherein said base mat includes a peripheral edge which includes serging, securing said foam rubber to said grass-like carpet, thereby preventing delamination of said base mat.

7. The structure of claim 6 wherein said base mat includes popypropylene material of the top side of said foam rubber which is secured thereto by said edge serging and adhesive.

8. The structure of claim 1 wherein said cushion layer of said base mat is further defined as being foam material.

9. The structure of claim 1 wherein said layer of grass-like carpet of said top pad, is further defined as being secured to said layer of belting type material by stitching.

* * * * *